US006851289B2

(12) United States Patent
Ramsauer

(10) Patent No.: US 6,851,289 B2
(45) Date of Patent: Feb. 8, 2005

(54) LEVER LOCK

(76) Inventor: Dieter Ramsauer, Max-Klein-Strasse 10, D-58332 Schwelm (DE)

( * ) Notice: Subject to any disclaimer, the term of this patent is extended or adjusted under 35 U.S.C. 154(b) by 0 days.

(21) Appl. No.: 10/416,372

(22) PCT Filed: Aug. 25, 2001

(86) PCT No.: PCT/EP01/09816

§ 371 (c)(1),
(2), (4) Date: Sep. 11, 2003

(87) PCT Pub. No.: WO02/38894

PCT Pub. Date: May 16, 2002

(65) Prior Publication Data

US 2004/0061342 A1 Apr. 1, 2004

(30) Foreign Application Priority Data

Nov. 13, 2000 (DE) ..... 200 19 113 U

(51) Int. Cl.[7] ..... E05B 13/10
(52) U.S. Cl. ..... 70/208; 70/215; 70/DIG. 31
(58) Field of Search ..... 70/209, 210, 215, 70/224, DIG. 31, 208

(56) References Cited

U.S. PATENT DOCUMENTS

| | | | | |
|---|---|---|---|---|
| 4,268,077 A | | 5/1981 | Bohleen et al. | 292/336.3 |
| 5,440,905 A | | 8/1995 | Yamada | 70/84 |
| 5,638,708 A | | 6/1997 | Hsu | 70/208 |
| 6,053,018 A | * | 4/2000 | Ramsauer | 70/208 |
| 6,546,764 B2 | * | 4/2003 | Segawa | 70/208 |
| 6,668,603 B2 | * | 12/2003 | Segawa | 70/208 |
| 6,694,786 B2 | * | 2/2004 | Gotou et al. | 70/213 |

FOREIGN PATENT DOCUMENTS

| | | |
|---|---|---|
| DE | 0 261 266 | 3/1988 |
| DE | 40 06 072 | 4/1991 |
| DE | 42 10 588 | 10/1993 |
| DE | 297 11 737 | 12/1998 |
| EP | 0 453 626 | 4/1990 |
| EP | 0 526 522 | 3/1994 |
| WO | WO 99/01634 | 1/1999 |

* cited by examiner

*Primary Examiner*—John B. Walsh
(74) *Attorney, Agent, or Firm*—Reed Smith LLP

(57) ABSTRACT

The description relates to a lever closure comprising a trough which can be fastened to a door leaf, a hand lever for driving a closure actuation device being arranged at one end of the trough such that it can be swiveled out or folded out, and a first locking device such as a cylinder lock is arranged at the other end of the trough for locking the hand lever in the swiveled in position, with another locking device supported by the hand lever and an engagement surface which is arranged at the free end of the hand lever and behind which a blocking element engages, this blocking element being movable by the first locking device for locking the hand lever in the swiveled in position. According to the invention, the engagement surface is formed by a slide which is movable in the hand lever in axial direction thereof or by a tongue which is rotatable about an axis vertical to the axial direction and swiveling axis.

24 Claims, 3 Drawing Sheets

LEVER LOCK

CROSS-REFERENCE TO RELATED APPLICATIONS

This application claims priority of International Application No. PCT/EP01/09816, filed Aug. 25, 2001 and German Application No. 200 19 113.6, filed Nov. 13, 2000, the complete disclosures of which are hereby incorporated by reference.

BACKGROUND OF THE INVENTION a) Field of the Invention

The invention is directed to a lever lock or lever closure such as a swivel lever closure or folding lever closure comprising a trough which can be fastened to a door leaf or the like, a hand lever for driving a closure actuation device being arranged at one end of the trough such that it can be folded out and/or swiveled, and a first locking device such as a cylinder lock or the like is arranged at the other end of the trough for locking the hand lever in the folded in position, with another locking device supported by the hand lever and an engagement surface which is arranged at the free end of the hand lever and behind which a blocking element engages, this blocking element proceeding from or being movable by the first locking device for locking the hand lever in the folded in position.

b) Description of the Related Art

A swivel lever closure which can be locked in a simple manner is known from EP 0261266 A1. In order to lock the swivel lever in its folded in position, a profile cylinder lock is accommodated in the swivel lever and stops with its cam or thumb against an engagement surface formed by the trough when locking is actuated by the cylinder lock when the lever is folded in. A disadvantage in locks of this type is the fact that a key which can get lost is required for opening or closing the lock. The key which is inserted into the cylinder lock is also troublesome when actuating, e.g., when folding up and/or swiveling, the swivel lever.

There are also swivel lever closures, e.g., in WO 99/01634, in which the swivel lever is held in the folded in position by means of a springing tongue, wherein unlocking is carried out by inserting a key into a cylinder whose thumb movement causes the unlocking or, more simply, by pressing on an unlocking button or knob which, e.g., pulls back a locking pin or locking tongue against spring force and unlocks the swivel lever so that it can be folded out.

Locking by means of a key-operated cam or thumb is disadvantageous, again, due to the impediment posed by the key and because the key call be lost, whereas the tongue lock in the known embodiment forms has the possible additional disadvantage that, while meeting the demands of normal operation, it can easily be overcome in case of unauthorized, particularly forceful, attempts at opening.

The construction according to EP 0261266 A1 is more advantageous than WO 99/01634 insofar as it has a greater resistance to unauthorized attempts at opening. This is due to the fact that in WO 99/01634 the forces must be applied by the area of the trough located in front of the door leaf plane, and accordingly can not be supported directly on the rear surface of the door leaf.

A lever closure with a double lock, one in the trough and one in the hand lever, is already known from European Patent 0 526 522 B1. Reference is had particularly to the embodiment form shown in FIGS. 1 to 3 of this reference.

In switch cabinets which must be monitored by the maintenance personnel of an electric power plant but whose interior must also be accessible to the clientele of this electric power plant so as to monitor its operation, it is advantageous to lock and unlock the closure with two different keys.

The known construction is very solid, but also very costly to produce and therefore not optimal for many purposes. Further, the key in the hand lever is troublesome as is the relatively large overall length resulting from the fact that two relatively long cylinder locks are arranged in tandem. In applications where lower expenditure is required or less space is available, these known closure devices can not always be used.

The closing device according to DE 40 06 072 C1 also has the disadvantage of a relatively large structural length. Another disadvantage consists in a large structural width which is caused by a slide which is mounted so as to be displaceable in the trough vertical to the longitudinal axis of the trough, which slide is There are also swivel lever closures, e.g., in WO 99/01634, in which the swivel lever is held in the folded in position by means of a springing tongue, wherein unlocking is carried out by inserting a key into a cylinder whose thumb movement causes the unlocking or, more simply, by pressing on an unlocking button or knob which, e.g., pulls back a locking pin or locking tongue against spring force and unlocks the swivel lever so that it can be folded out.

Locking by means of a key-operated cam or thumb is disadvantageous, again, due to the impediment posed by the key and because the key can be lost, whereas the tongue lock in the known embodiment forms has the possible additional disadvantage that, while meeting the demands of normal operation, it can easily be overcome in case of unauthorized, particularly forceful, attempts at opening.

The construction according to EP 0261266 A1 is more advantageous than WO 99/01634 insofar as it has a greater resistance to unauthorized attempts at opening. This is due to the fact that in WO 99/01634 the forces must be applied by the area of the trough located in front of the door leaf plane, and accordingly can not be supported directly on the rear surface of the door leaf.

A lever closure with a double lock, one in the trough and one in the hand lever, is already known from European Patent 0 526 522 B1. Reference is had particularly to the embodiment form shown in FIGS. 1 to 3 of this reference.

In switch cabinets which must be monitored by the maintenance personnel of an electric power plant but whose interior must also be accessible to the clientele of this electric power plant so as to monitor its operation, it is advantageous to lock and unlock the closure with two different keys.

The known construction is very solid, but also very costly to produce and therefore not optimal for many purposes. Further, the key in the hand lever is troublesome as is the relatively large overall length resulting from the fact that two relatively long cylinder locks are arranged in tandem. In applications where lower expenditure is required or less space is available, these known closure devices can not always be used.

The closing device according to DE 40 06 072 C1 also has the disadvantage of a relatively large structural length. Another disadvantage consists in a large structural width which is caused by a slide which is mounted so as to be displaceable in the trough vertical to the longitudinal axis of the trough, which slide is displaceable by means of a first half-cylinder arranged in the trough and forms a lock for the hand lever or for the lock bolt of a second cylinder arranged in the hand lever.

U.S. Pat. No. 4,268,077 A is also mentioned, although it has an even greater structural length because the hand lever carries devices to lock it in its center instead of at the free end.

A swivel lever closure according to EP 0 453 626 B1 has a very large structural length due to its design, wherein two half-cylinders which are arranged in tandem either in the trough (FIGS. 5, 6) or in the hand lever (FIGS. 1–3) actuate a locking strip that is arranged in the trough or in the hand lever so as to be axially displaceable.

OBJECT OF THE INVENTION

It is the primary object of the invention to provide a closure device of the type mentioned in the beginning for applications which have less available space and/or which do not justify too great an expenditure and in which, in addition, the hand lever makes do without a key.

SUMMARY OF THE INVENTION

This object is met in that, according to a first alternative, the engagement surface is formed by a slide which is movable in the hand lever in the axial direction thereof or, according to a second alternative, by a slide which is movable in the hand lever in axial direction thereof, or by a tongue which is rotatable about an axis vertical to the axial direction and swiveling axis, wherein in the first alternative the blocking element forms a hook which is swivelable against spring force and forms an inclined surface that is engaged by the end of the slide when the hand lever swivels in and is swiveled against the spring force, while in the second alternative the locking device comprises an actuating knob which is arranged on the upper side of the swivel lever at a locking shaft arranged vertical to the plane of the upper side, the locking shaft penetrates the swivel lever and carries a tongue or the like at its end, which tongue stops on an engagement surface formed or held by the receptacle trough during the rotation of the actuating knob and, therefore, of the locking shaft into the locking position, and wherein the actuating knob has a locking projection which can move out of its lower end and which can be received in a recess formed by the lever.

As a result of these features, there is no further need for two cylinder locks as in the prior art as set forth in EP 0526522 B1, so that the entire arrangement can be kept shorter. Further, the arrangement allows constructions that are more variable than those in the prior art particularly with respect to a simplified and therefore cheaper design, for example, simply in that the slide is in an operative connection with a combination lock and/or trigger button arranged on the upper side of the hand lever.

An embodiment form with only a trigger button is suitable for applications in which the latter serves only for additional securing of the swiveled in state, e.g., in order to prevent the closure from being opened in an unwanted manner by shaking movements also when the cylinder in the trough is not closed.

If greater security is desired, particularly against unauthorized tampering, the slide or the tongue, possibly in addition to the button, can also be in an operative connection with a lock arranged in the hand lever according to another embodiment form of the invention; in particular, it can be combined with it in such a way that it can be locked in its position forming an engagement surface. It is advisable — for reasons of space and because it dispenses with the need for another key—to provide a lock of this kind in the form of a combination lock. This combination lock can be constructed in such a way that it automatically unlocks, e.g., pulls back the slide, when the correct combination is set or entered.

In a particularly simple construction, the blocking element is formed by the thumb or bolt of a cylinder lock or the like. Operation is simplified, however, when the blocking element forms a hook which is swivelable against the force of a spring and forms an inclined surface that is engaged by the end of the slide when the hand lever swivels in and is swiveled against the spring force. This free-running makes it possible to fold the hand lever into its locked position without having to waste time on both locks, that is, without having to be in possession of a key or combinations for the combination lock.

The hook can be formed by a lever which can be fastened in the receptacle or held in a swivelable manner by a bearing formed integral therewith, the end of the lever remote of the hook being engaged by the thumb or bolt of a cylinder lock or the like. This is a particularly elegant variant of the design solution.

This construction can also be realized in that the bearing is formed by a slot which is formed by the trough and which is closed by a sheet metal part that is held at the trough by head screws.

In order to facilitate operation, the hand lever can advantageously be folded in against spring force.

According to another embodiment form, the locking device comprises an actuating knob which is held on the upper side of the swivel lever around a locking shaft which is arranged vertical to the plane of the upper side. The locking shaft penetrates the swivel lever and carries a fastener tongue at its end; during the rotation of the actuating knob and, therefore, of the locking shaft into the locking position, the fastener tongue stops against an engagement surface which is formed or held by the trough.

In another embodiment form, the actuating knob or locking knob has a locking projection which can move out of its lower end directed toward the lever or receptacle and which can be received in an offset or recess formed by the lever.

A particularly large torque can be ensured when the actuating knob is mounted eccentrically and has a pin at its end remote of the axis, which pin can be moved out from the underside and moves into a recess.

In order to prevent unauthorized opening which was formerly achieved through cylinder lock devices, it is provided herein that the locking knob comprises a keyboard or adjusting wheels on its upper side for entering a multiple-digit number or combination of characters. When the locking knob is connected to a drive for the pin in such a way that the pin is drawn back after a determined first series of characters is entered, according to a further development of the invention, a particularly secure locking is achieved which does not have the disadvantages of locking by means of a cylinder lock or the like as is described above.

The locking knob can be connected with a drive for the pin in such a way that the pin is moved out when a locking position is reached and/or when another series or combination of characters is entered.

The locking knob can form a shoulder or projection which proceeds from the lower end of its circumference and arrives under an engagement that is formed or carried by the trough when the locking knob is rotated into its locking position. This results in additional security against attempted opening by means of a tool like a screwdriver when the locking knob is moved into its locking position. It is also advantageous that, e.g., the swivel lever with the locking knob can be so designed externally that it can be used in a commercially available swivel lever bar closure or the like instead of a swivel lever provided with a cylinder locking mechanism.

Due to the more compact construction compared to the prior art, it is also possible in particular to replace a conventional closure with two-hole fastening of a certain design with the new closure because its outer dimensions do not exceed those of conventional closures, particularly certain designs of swivel lever closures.

BRIEF DESCRIPTION OF THE DRAWINGS

The invention will be described more fully in the following with reference to embodiment examples shown in the drawings.

DESCRIPTION OF THE PREFERRED EMBODIMENTS

Figure 1:
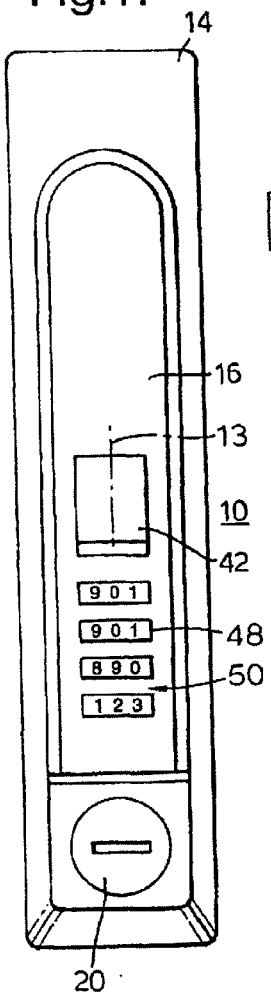
FIG. 1 is a top view of a lever closure constructed according to the invention.
Figure 4:
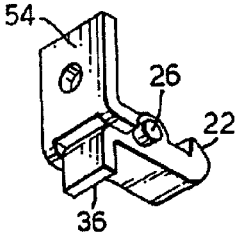
FIG. 4 shows a perspective view of the locking hook.

FIG. 1 shows a top view of a lever closure 10, particularly in this case a swivel lever closure, comprising a trough 14 which can be fastened to a door leaf 12 (see FIG. 2) or the like. A swivelable (see dashed lines in FIG. 2) hand lever 16 for driving a closure actuating device 18 is arranged at one end of the trough 14 and a first locking device, such as a cylinder lock 20, for locking the hand lever 16 in the swiveled in position is arranged at the other end of the trough 14. The locking of the hand lever in the swiveled in position (see solid lines in FIG. 2) is carried out either directly by means of the thumb 34 or bolt of a cylinder lock 20 or the like arranged in the trough 14 or, as in the present case, in that a hook device 22 which is shown again in a perspective view in FIG. 4 engages an engagement surface 24 which is formed by the free end of the hand lever 16 or is arranged at the latter. This blocking element formed by the hook device 22 is swivelable in the clockwise direction around a hinge pin 26 out of the position shown in FIG. 2 against the force of a spring 28, so that the hook 22 releases the engagement surface 24 and the hand lever 16 can accordingly be swiveled or folded out of its locked position. During this folding out process, the closure 18 is either actuated already or, as in the present embodiment form, the possibility is provided for rotating a drive shaft 30 of a closure, not shown in more detail, in that the hand lever 16 which is articulated at the end of the shaft 30 around a hinge pin 32 extending parallel to the door leaf plane and vertical to the axis of the shaft 30 is rotated around this hinge pin 32. This construction is also selected in the prior art.

In this case, a cylinder lock 20 serves to swivel the hook or the blocking element 22 around the hinge pin 26. When the cylinder of the cylinder lock 20 rotates, the thumb 34 of the cylinder lock 20 engages with the end 26 of the blocking element or lever 22 and, in so doing, the lever-shaped blocking element 22 moves around the axis 26 in clockwise direction and releases the engagement surface 24 in the manner described above.

Figure 2:
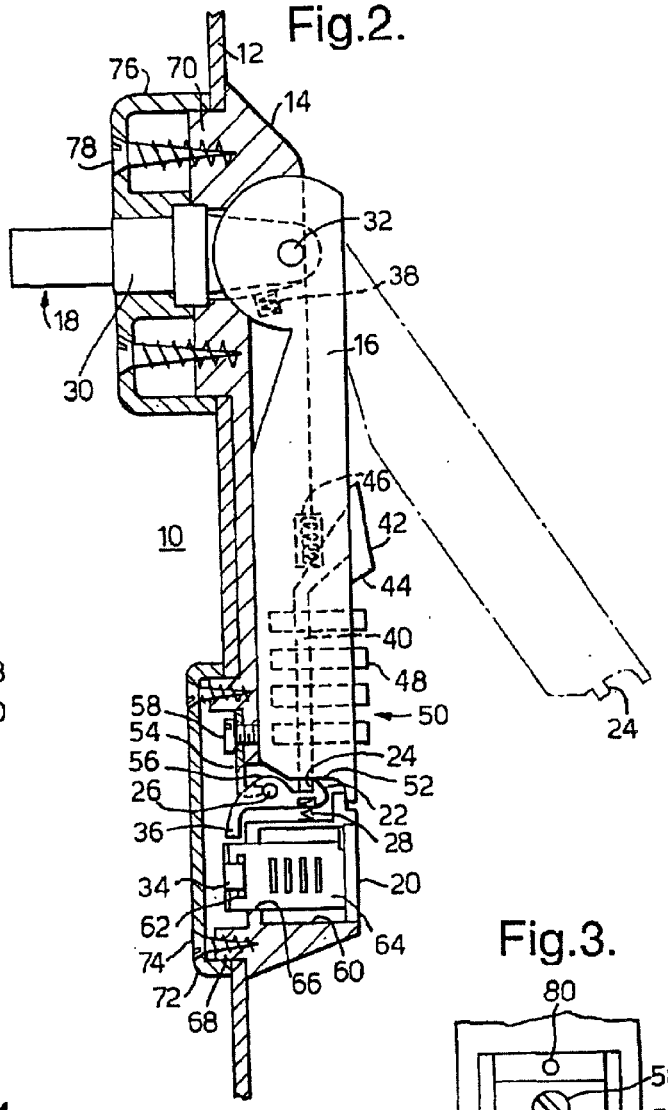
FIG. 2 shows an axial sectional view of the lever closure shown in FIG. 1.
Figure 3:
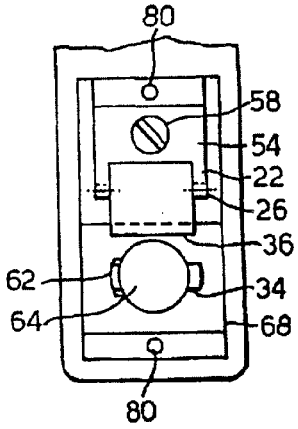
FIG. 3 shows a view from the rear of the lower end of the lever closure according to FIGS. 1 and 2.

Due to the spring force (see pressure spring 38), the hand lever 16 swivels out of the position shown in solid lines in FIG. 2 into the open position shown in FIG. 2 by dashed lines.

The engagement surface 24 is not formed by a fixed protuberance, but rather by a slide 40 in the hand lever which is movable in the axial direction of the latter. While one end of the slide 40 projects out of the end of the hand lever and, in so doing, forms the engagement surface 24, the slide opens at its other end into a sliding button 42 arranged on the surface of the lever. By pressing with the thumb, e.g., on the surface 44 of the button 42, the slide 40 can be displaced in such a way that the engagement surface 24 is retracted into the hand lever and the hand lever 16 is also released in this way. This pushing movement can be carried out against the force of a spring 46, so that the movement back into the starting position is carried out possibly automatically by means of spring force.

At the same time or alternatively, the slide 40 can be combined with a combination lock, e.g., one with several number wheels 48, e.g., in this case, four, resulting in a combination lock which enables or automatically causes a displacement of the slide 40 into the release position only when the four number wheels are correctly set. The combination of number wheels 48 and the displaceable slide 40 with or against the force of a spring 46 accordingly presents another locking device 50 which is arranged on the hand lever 6 and which makes it possible to cancel the locking of the hand lever 16 independent from the cylinder lock 20. The spring 28 makes it possible for the hook 22 to execute a free-running movement, so that in cooperation with an inclined surface 52 the hand lever with pushed out engagement surface 24 can be swiveled in again and locked without having to move the cylinder lock 20 or the slide 40. Similar to a door with a latch lock, that is, a normal room door, the hook 22 is deflected out because of the inclined surface 52 when the hand lever 16 is swiveled in with the projecting end 24 of the slide 40 against the force of the spring 28 and snaps in again at the inclined surface 52 after the end 24 runs past. The hand lever can accordingly be swiveled in and locked without knowledge of the combination of the combination lock 50 and also without a key for the cylinder lock 20.

A few details ensuring a simple and stable construction of the arrangement according to the invention will be mentioned. The hook 22 shown in FIG. 4 has shaft projections which are arranged on both sides and mounted in a stable manner in open slots 56 of the trough 14. A mounting plate 54 which is held at the trough 14 by means of head screws, 58 close the slots and accordingly prevent the hinge ends 26 from sliding out of the hook device 22. The mounting of the cylinder lock 20 in the trough 14 can be solved in a simple manner in that a corresponding round bore hole 60 in the trough 14 receives the cylinder lock 60, part of whose core 64 extends through a corresponding inner opening 66 and is held axially by a tiltable holding part 62. This part 62 can form the thumb 34 at the same time.

The lever closure shown here has the external shape of or is compatible with a swivel lever closure system, known per se, and can be arranged in this system. The system allows the lever closure to be mounted in a thin wall such as a sheet metal cabinet door in that the trough 14 has two projections 68, 70 penetrating the door leaf. One projection 70 is suitable for receiving in a closure drive shaft 18, at which shaft the swivelable hand lever 16 is articulated (see hinge pin 32), while the other projection 68 has a countersink 60, 66 for receiving the cylinder lock 64 holding the swivel lever in its swiveled in position. Both projections have fastening means 72, 74, 76, 78 for fixing the trough in the thin wall such as a door leaf 12. According to the view in FIG. 2, these fastening means comprise covers 74, 76 which enclose projections 68, 70 extending through openings in the door leaf and which clamp the edges of the openings of the thin wall 12 between themselves and the trough by means of head screws 74, 76 screwed into bore holes 80 in the trough 14.

In applications in which the cylinder lock is not to be used, that is, when actuation by means of the button and/or the combination lock on the hand lever is sufficient, the cylinder can be omitted and the cylinder opening can be closed by a simple stopper.

Figure 5:
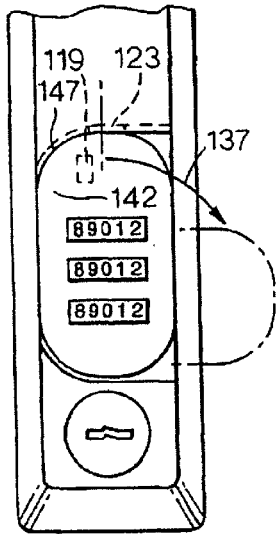
FIG. 5 shows a partial top view of another construction of a lever closure according to the invention.
Figure 6:
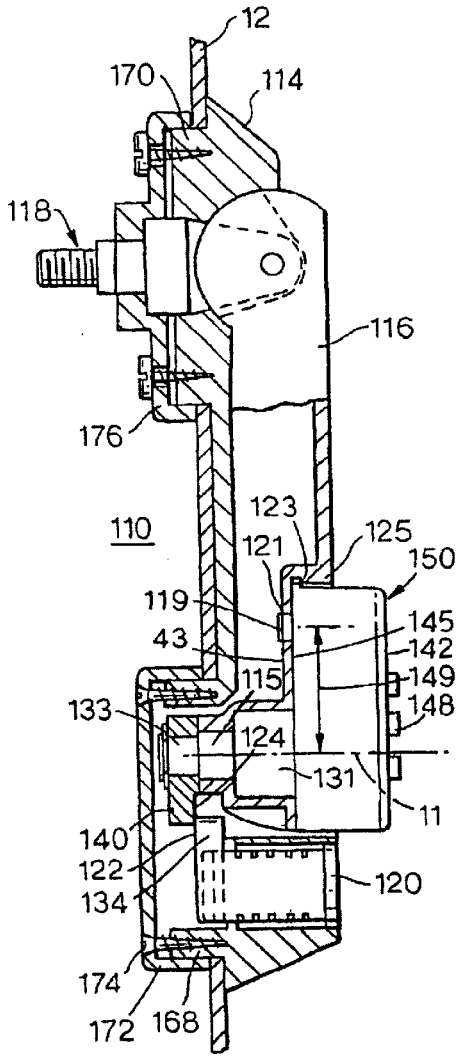
FIG. 6 shows an axial sectional view of the arrangement shown in FIG. 5.
Figure 7:
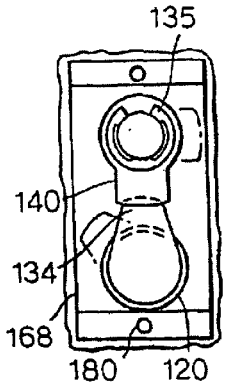
FIG. 7 shows a view from the rear of the lower end of the lever closure according to FIGS. 5 and 6 with the cap removed.

A swivel lever closure 110 with a receiving trough 114 arranged on a door leaf 12 is likewise provided in the embodiment form shown in FIGS. 5, 6 and 7. The trough 114 is guided by two projections 168, 176 which are rectangular in cross section through corresponding openings in the door leaf 12 which center the closure in the door leaf. Clamping screws such as head screws 174 are screwed into corresponding, possibly self-cut, threaded bore holes 180 in these projections 168, 176, so that the trough 114 can be clamped to the door leaf with the intermediary of, e.g., cover caps 172, 176. Reference is had to EP 0261266 A1 for further fastening possibilities.

In the embodiment form shown herein, the locking device 150 is an actuating knob 142 which is arranged on the upper side of the swivel lever 116 or in a countersink formed by the latter and which has a shaft projection 131 with a first diameter and a second shaft projection or a locking shaft 115 with a second, smaller diameter that passes into a square 133 on which the tongue 140 is mounted so as to be rigid against rotation. The tongue can be prevented from sliding off the square by providing, for example, a retaining ring 135 arranged in a circumferential groove (see also FIG. 7). Instead of this, an axial bore hole could also be provided in the square, and a head screw which holds the tongue, possibly with a washer disposed therebetween as can be seen in the embodiment form according to FIGS. 8 to 10, could be screwed into the square.

The spacing conditions and the shape of the tongue 140 are arranged in such a way that when the actuating handle 142 is in the position shown by solid lines in FIG. 5 the tongue occupies the position shown in FIG. 6 in which the engagement surface 124 formed by the tongue 140 engages with the blocking element 122 formed by the tongue 122 of the cylinder lock 120, the swivel lever 116 is stopped in this position inside the trough 114. However, when the actuating handle 142 is rotated, for example, in the direction of arrow 137 in FIG. 5 into a position shown in dash-dot lines, the tongue 140 reaches the position shown in dashed lines in FIG. 7 in which it has released the blocking element 122. The hand lever can now be swiveled out. Alternatively, the cylinder lock, designated by 120, can also be actuated by means of a key, whereupon its tongue with the engagement surface 122 can be rotated, e.g., by 45° according to FIG. 7, whereupon, without actuating the actuating knob 142, the tongue 140 is released from the engagement surface 122 and the hand lever can be swiveled out again.

Accordingly, while the cylinder lock 20 the thumb 34 in the embodiment form according to FIG. 2 serves to actuate the lever, it is the thumb 134 itself in this case that forms the holding surface for the tongue 140 and its engagement surface 122.

Figure 8:
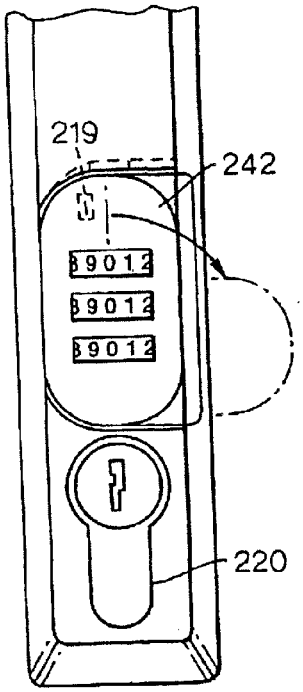
FIGS. 8, 9 and 10 show corresponding views similar to FIGS. 5, 6 and 7 with respect to another lever closure according to the invention.
Figure 9:
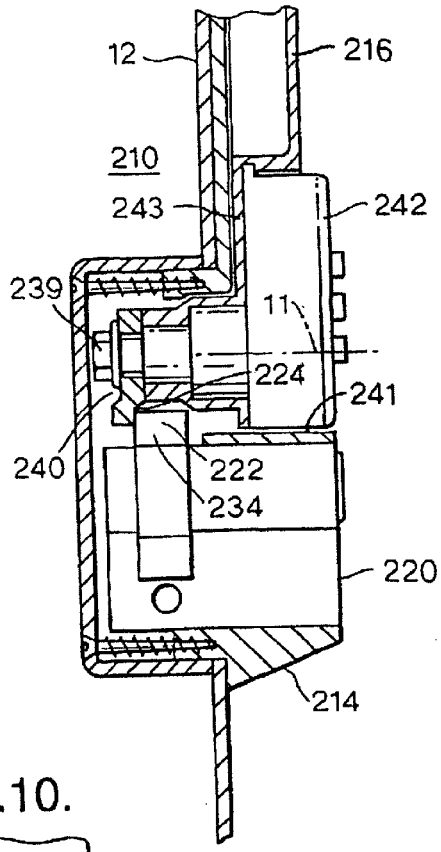
Figure 10:
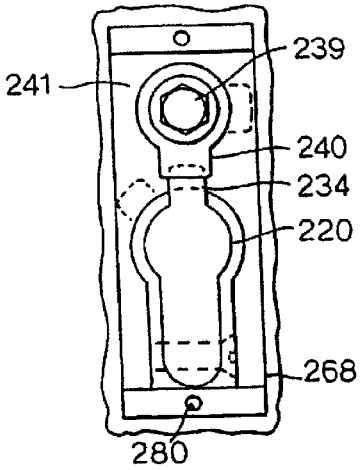

In the embodiment form shown in FIGS. 8, 9 and 10, it is a thumb 134 of a cylinder lock 220 that takes over this function. In this case, it is the tongue 240 that is rotatable by the actuating handle 242 shown therein which is fastened by means of head nuts 239 and which can be swiveled out of the area of the thumb 234 as can be seen in FIG. 10. Alternatively, however, the cylinder lock 220 can also be actuated by means of keys in order to bring the thumb 234 into the position shown in dashed lines in FIG. 10, whereupon the swivel lever 216 can also be swiveled out of the trough 214.

It is advantageous when the length of the tongue 240 is kept small enough that it remains flush with an opening 241 formed in the trough 214, a similar opening being provided in the prior art, so that a trough constructed according to the prior art could also be used in this case.

In order to prevent the knob 142 or 242 from moving out of its position (locking position) shown in FIGS. 5 and 8 in an unwanted manner into the release position shown in dashed lines, for example, due to shaking of the closure or unauthorized actuation, it is advisable to provide a device for locking the actuation knob in the position in which the tongue 140 and 240 according to FIGS. 6 and 9, respectively, has reached its locking position (see the solid line of the tongue 140 and 240).

In the embodiment form shown in FIG. 6, this is effected in that the actuating knob 142 is provided at its lower surface 145 facing the door leaf with a locking projection or pin 119 which can move out and be received in a countersink or opening 121 formed by the lever 116, specifically by its offset wall 145.

In order to achieve the largest possible rotating lever arm 149 between the pin or projection 119 on the one hand and the rotational axis 11 of the locking shaft 115 on the other hand, it is advisable according to the embodiment form shown in FIGS. 5 and 6 or 8 and 9 to construct the actuating knob 142 and 242 eccentrically and to provide the above-mentioned telescoping pin 119 at its end remote of the axis as is shown in FIG. 6.

In order to move the pin 119 in and accordingly enable the rotation of the actuating knob 142 or 242 (the pin is not shown in the latter case), a mechanical device can be provided, for example, a lever connection, not shown, between the pin 119 and one or more buttons or number wheels 148. When pressing the button 143, for example, or rotating the corresponding number wheel, the pin 119 is drawn back against spring force by a lever rod linkage, i.e., it is released from the countersink 121, and accordingly makes it possible for the actuating knob 142 to be rotated out of the locking position shown in solid ines in FIG. 5 (or FIG. 8) into a release position shown in dashed lines. A code can also be carried out by means of corresponding mechanical arrangements in that a release is effected only when certain combinations of a plurality of buttons and number wheels 148 are actuated. An electronic embodiment form in which the actuating knob 142 and 242 has a keyboard on its upper side which is used for entering a multiple-digit number or series of characters or combination of numbers and characters would also be conceivable. This can be carried out in that the actuating knob 142 is connected to an electric drive for the pin 119 in such a way that the pin 119 is drawn back by the drive when a certain sequence of characters is entered, for example. In order to carry out this process, a microprocessor can be arranged inside the knob together with the drive and a device for supplying the necessary energy for driving the pin 119 and operating the microprocessor, which device is realized, for example, by a battery, or round cell which may be rechargeable, or also by a transponder which makes it possible to introduce energy into the circuit from outside. Other energy sources are also possible, such as solar cells which could supply the flow of energy necessary for actuating the pin from the outside when sufficiently illuminated.

In order to bring the pin back into its former position again, it could be sufficient simply to move the actuating knob 142, 242 into its initial position which is shown in solid lines in FIGS. 5 and 8. For example, a mechanical or electronic trigger could cause the pin 119 to move into its locking position in the recess or countersink 121. Alternatively, this process could naturally also be initiated by entering the same or different code via the keyboard or the wheel arrangement.

In order to ensure that the actuating knob can not be lifted so far by inserting a tool into the side that the pin is freed from the recess 121 without being pulled back into the button, the actuating knob can form a projection 123 which proceeds from the lower end of its circumference and which arrives under an engagement portion 272, which is formed or carried by the trough 114, when the actuating button is rotated into its locking position.

It has already been mentioned that the swivel lever 116, including the actuating knob 142 (the same applies to the arrangement shown in FIG. 9) can be designed in such a way that it can be used instead of a swivel lever provided with a cylinder lock according to the commercially available construction. Swivel levers can be exchanged in this way even when it is desirable to convert key-operated locks to electronic locks.

In order to ensure that the actuating knob 142 or 242 is oriented in its swiveled in, locked position in such a way that the pin 119 is able to move out into the countersink 121 in a precise manner, it is sensible to provide a stop which fixes the exact position, for example, serves to hold a stop wall 147 formed by the trough 116 and the rotating knob 142 during rotation in the opposite direction to the direction indicated by the arrow 137 in the position in which the contour of the pin 119 is exactly aligned with the corresponding contour of the countersink or opening 121.

The expanded shaft projection 131 provides particularly good guidance in the corresponding bearing arrangement of the hand lever 116, but at the same time also serves to accommodate electronic components and battery devices, as the case may be.

The invention is commercially applicable in switch cabinet construction.

While the foregoing description and drawings represent the present invention, it will be obvious to those skilled in the art that various changes may be made therein without departing from the true spirit and scope of the present invention.

What is claimed is:

1. A lever closure comprising:

a trough which can be fastened to a door leaf;

a hand lever for driving a closure actuation device being arranged at one end of the trough such that it can be folded out, swiveled, or combinations thereof;

a first locking device such as a cylinder lock being arranged at the other end of the trough for locking the hand lever in the folded in position;

another locking device supported by the hand lever and an engagement surface being arranged at the free end of the hand lever and behind which a blocking element engages;

said blocking element proceeding from or being movable by the first locking device for locking the hand lever in the folded in position;

said engagement surface being formed by a slide which is movable in the hand lever in the axial direction thereof; and said blocking element forming a hook which is swivelable against spring force and which forms an inclined surface that is engaged by the end of the slide when the hand lever swivels in and is swiveled against the spring force.

2. A lever closure comprising:

a trough which can be fastened to a door leaf;

a hand lever for driving a closure actuation device being arranged at one end of the trough such that it can be folded out, swiveled, or combinations thereof;

a first locking device such as a cylinder lock being arranged at the other end of the trough for locking the hand lever in the folded in position;

another locking device supported by the hand lever and an engagement surface being arranged at the free end of the hand lever and behind which a blocking element engages;

said blocking element proceeding from or being movable from the first locking device for locking the hand lever in the folded in position;

said engagement surface being formed by a tongue which is rotatable about an axis vertical to the axial direction and swiveling axis;

said locking device comprising an actuating knob which is arranged on the upper side of a swivel lever at a locking shaft arranged vertical to the plane of the upper side;

said locking shaft penetrating the swivel lever and carrying a tongue at its end, which tongue stops on an engagement surface formed or held by the receptacle trough during the rotation of the actuating knob and, therefore, of the locking shaft into the locking position; and said actuating knob having a locking projection which can move out of its lower end and which can be received in a recess or countersink formed by the lever.

3. The lever closure according to claim 1, wherein the slide or the tongue is in an operative connection with a lock, trigger button, or combinations thereof or trigger knob arranged on the upper side of the hand lever.

4. The lever closure according to claim 2, wherein the tongue is in an operative connection with a lock, trigger button, or combinations thereof or trigger knob arranged on the upper side of the hand lever.

5. The lever closure according to claim 1, wherein the slide is combined with a lock arranged in the hand lever in such a way that it can be locked in its position forming an engagement surface.

6. The lever closure according to claim 2, wherein the tongue is combined with a lock arranged in the hand lever in such a way that it can be locked in its position forming an engagement surface.

7. The lever closure according to claim 5, wherein the lock arranged in the hand lever is a combination lock.

8. The lever closure according to claim 1, wherein the blocking element is formed by the thumb or bolt of a cylinder lock.

9. The lever closure according to claim 1, wherein the hook is formed by a lever which can be fastened in the receptacle or held in a swivelable manner by a bearing formed integral therewith, the end of the lever remote of the hook being engaged by the thumb or bolt of a cylinder lock.

10. The lever closure according to claim 9, wherein the bearing is formed by a slot which is formed by the trough.

11. The lever closure according to claim 10, wherein the slot is closed by a sheet metal part that is held at the trough by head screws.

12. The lever closure according to claim 2, wherein the actuating knob is mounted eccentrically and has a pin at its end remote of the axis, which pin can be moved out from the underside and moves into a recess.

13. The lever closure according to claim 2, wherein the actuating knob has one or more buttons or adjusting wheels on its upper side in order to draw back the locking pin out of its locking position.

14. The lever closure according to claim 13, wherein the function of drawing back is only carried out when a determined sequence of characters or combination of several characters is entered by pressing the buttons or turning the wheels.

15. The lever closure according to claim 2, wherein the function of pulling out is carried out by entering a different multiple-digit number or combination of characters.

16. The lever closure according to claim 2, wherein the buttons of the actuating knob are connected to a microprocessor-controlled electronic drive unit which displaces or draws back the pin when a determined sequence of characters is entered.

17. The lever closure according to claim 2, wherein the pin is connected to a drive in such a way that the pin is automatically moved out in a locking manner, when the actuating knob is reset in its locking or closing position.

18. The lever closure according to claim 2, wherein the pin is controllable in such a way that it moves out when a determined sequence of characters is entered only when the actuating knob is in its locking or closing position.

19. The lever closure according to claim 2, wherein the actuating knob forms a projection which proceeds from its circumference and arrives under an engagement portion that is formed or carried by the receiving trough when the actuating knob is rotated into its locking or closing position.

20. The lever closure according to claim 1, wherein the hand lever can be folded in against spring force.

21. The lever closure according to claim 1, wherein the cylinder lock is held in the trough by a holding part which can be clipped in and which simultaneously forms the thumb of the cylinder lock.

22. The lever closure according to claim 1, wherein the lever closure is a swivel lever closure for mounting in a thin wall such as a sheet metal cabinet door whose trough has two projections penetrating the door leaf, wherein one projection is suitable for receiving a closure drive shaft, at which shaft the swivelable hand lever is articulated, and wherein the other projection has a countersink for receiving the cylinder lock device holding the swivel lever in its swiveled in position, and in that both projections have fastening means for fixing the trough in the thin wall.

23. The lever closure according to claim 22, wherein the fastening means are formed by caps which can be arranged on the projections by head screws which can be screwed into bore holes in the trough, and wherein the caps clamp the edges of the openings in the thin wall penetrated by the projections between themselves and the trough.

24. The lever closure according to claim 1, wherein the external shape of the lever closure makes possible an exchange with existing, commercially available lever closures.

* * * * *